United States Patent [19]

Whittington et al.

[11] 4,129,055

[45] Dec. 12, 1978

[54] ELECTRONIC ORGAN WITH CHORD AND TAB SWITCH SETTING PROGRAMMING AND PLAYBACK

[75] Inventors: Billy J. Whittington, Jasper; Timothy L. Burns, French Lick; Alan B. Welsh, Jasper, all of Ind.

[73] Assignee: Kimball International, Inc., Jasper, Ind.

[21] Appl. No.: 797,931

[22] Filed: May 18, 1977

[51] Int. Cl.[2] ..... G10H 1/00

[52] U.S. Cl. ..... 84/1.01; 84/1.03; 84/1.17; 84/1.11; 84/1.19; 84/DIG. 22

[58] Field of Search ..... 84/1.01, 1.03, 1.17, 84/1.11, 1.19, DIG. 22

[56] References Cited

U.S. PATENT DOCUMENTS

| | | | |
|---|---|---|---|
| 3,604,299 | 9/1971 | England | 84/1.03 |
| 3,821,712 | 6/1974 | Wetzel | 84/1.01 X |
| 3,878,750 | 4/1975 | Kapps | 84/1.03 X |
| 3,889,568 | 6/1975 | Amaya | 84/DIG. 22 X |
| 3,890,871 | 6/1975 | Oberheim | 84/1.01 |
| 3,915,047 | 10/1975 | Davis et al. | 84/1.03 |
| 3,935,781 | 2/1976 | Katoh et al. | 84/1.11 |
| 3,986,424 | 10/1976 | Sakashita | 84/DIG. 22 X |

*Primary Examiner*—Ulysses Weldon

*Attorney, Agent, or Firm*—Albert L. Jeffers; John F. Hoffman

[57] ABSTRACT

Circuitry in an electronic organ for electronically storing a series of signals corresponding to depressed keys depression and for recalling the stored series in response to player commands.

The circuit allows the player to play accompaniment chords of a piece of music alone and at any desired pace, and then while manually rendering the righthand, or solo, portion of the music. The chords are played by simply depressing a single control button whenever the next chord in the stored series is required.

A further feature of the invention is the ability to store sets of switch or tab or other selector element settings for later recall. The selector element setting storage circuit enables the player to switch tab settings during storage of chords, while storing the patterns in the order in which they will be desired.

A combination of the two features referred to allow a player to prestore both chord and tab information pertaining to a piece of music and recall both chord and tab information at will by pressing a single button.

Information of any sort that can be selected can be stored by the arrangement according to the present invention including information pertaining to rhythms, presets, tremelo, vibrato, volume, or expression control as well as other selectable or variable elements under the control of the organ player.

14 Claims, 7 Drawing Figures

NO CHORD
PROG/PLAY
KEY CHANGE PULSE
BLABTICH
CNTR
SHIFT REGISTER
RESET
PROG
PLAY
REV.
ADV.
CK

ELECTRONIC ORGAN WITH CHORD AND TAB SWITCH SETTING PROGRAMMING AND PLAYBACK

BRIEF SUMMARY OF THE INVENTION

The present invention relates to electronic organs and more particularly to those electronic organs which include circuits for automatic playing of notes, or note patterns, in response to the depression of one of a predetermined group of keys, hereinafter referred to as control keys, and which may comprise a group of adjacent keys near the left end of accompaniment section of the keyboard.

The invention relates specifically to a method of and circuitry for automatically storing in a memory a signal representing each depression of the control keys, in order, and for then, later, recalling the stored series of signals.

The invention consist of a multiple station, or multiple stage, memory device, such as an electronic read-write memory, and a control circuit pertaining to the memory, which allows a player to program signals corresponding to key depressions into the memory, or to read the stored information from the memory, as desired.

The control circuit, when in the program mode, or write, will store a digital signal corresponding to each depressed key automatically into the next available location, or station, of the memory. The control circuit also records the location, or station, last used in the programming for later use during the playback mode.

Further control switches are also provided which allow the operator to back up one station of the memory during programming to correct an error or to reset the memory.

With the control circuit switches to recall, or playback mode, the control circuit will recall the signal stored in the first location of the memory and will convert the signal into an electric signal for actuation of the circuits normally controlled by the key to which the stored signal responds.

The control circuit will recall the information in the storage location next in line each time a switch, or button, provided for this purpose, is pressed.

When the storage location which had been used last is recalled, and the recall button is again depressed, the control circuit will return to the first location of the memory to begin a new cycle.

If the keys being stored are automatic chord playing keys of an organ, the player can store the pattern of chords which are called for in a selection of music, and then concentrate fully on playing the melody portion of the music while recalling the stored chords simply by pressing the recall button each time a new chord is called for.

In addition to the circuit described above, the present invention includes an additional memory and control circuit therefor for storing the several sets of selector elements, such as tab switch patterns, that might be required during a musical selection.

In order properly to accommodate the variety of patterns possible for tab switches, tab switch information is stored in the form of a multiplexed data stream in which a signal corresponding to the setting of each tab switch is in each time slot, and upon recall, is demultiplexed to activate the appropriate tab control circuits.

The tab switches control, as is known, the routing of tone signals to the voicing circuits of the organ.

Storing of tab information is not done in response to changes in the tab switch closures, as more than one switch will likely be changed from one pattern to the next. Rather, the storing of tab information is controlled by a "store" button, so that the operator may readily select the desired pattern of tab switches and then store that pattern, without erroneously storing undesired patterns for each change in the tab switches.

The two circuits discussed above are combined in the third portion of the present invention, and wherein both the control key depressions and the tab switch patterns are automatically stored whenever a control key is depressed while the system is in the program mode.

The tab switches are not restored each time a control key is depressed but, rather, any time the pattern of tab switches is changed, the new pattern is stored into the next location, station, or stage, in the tab memory when the next control key is depressed. The tab memory, similarly to the memory in which the key information is stored, is also a multiple line memory with selective access to the several lines.

The tab memory system is also provided with a second, control, memory which stores the memory location of the control key memory for each time the tab switch pattern is changed. Thus, in this embodiment of the invention, a player can go through a sheet of music and store in respective memories both the chords and the patterns of tab switch settings which are called for. The player can then switch the system into playback mode and recall both chords and tab patterns by depression of a single recall button while remaining free to concentrate on playing the melody portion of the music.

It is, therefore, an object of the present invention to provide a circuit for storing signals corresponding to depressions of at least certain keys in the order of depression thereof and then to recall the stored information for actuation of the tone producing circuits normally controlled by the respective keys.

It is a further object of the present invention to provide a circuit for storing patterns of tab switch settings and to recall the patterns and to provide appropriate signals for activating the respective circuits normally controlled by the tab switches.

It is a still further object of the present invention to provide a circuit for automatically storing and for recalling at will both tab switch patterns and key depressions simultaneously.

These and other objects and advantages of the present invention can better be understood by reference to the following detailed description taken in connection with the attached drawings, in which.

DETAILED DESCRIPTION OF THE INVENTION

In order to simplify the following description, those circuits shown which are conventional will not be described in detail, and the circuit of the present invention will be discussed in stages.

Figure 1:
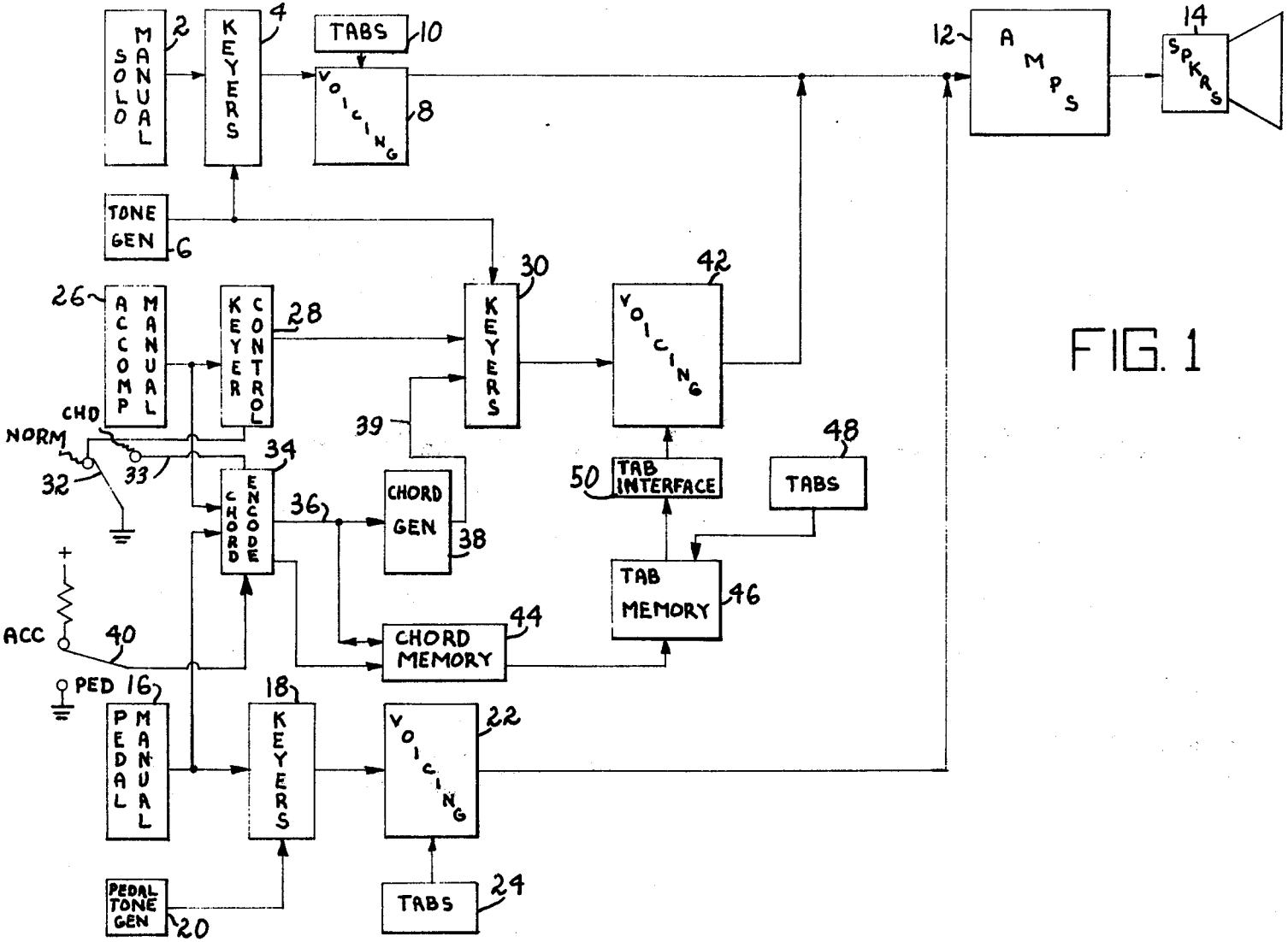
FIG. 1 is a block diagram of an organ including the circuit of the present invention.

Referring to FIG. 1, a greatly simplified block diagram of an organ is shown. A solo manual 2 operates, in a conventional manner, to activate selective ones of keyers 4 to pass corresponding tones of a tone generator 6 via voicing circuit means 8, under the control of tab switches 10, to amplifier 12 and then to speaker means 14.

Similarly, a pedal manual 16 activates keyers 18 to pass selected tones from tone generator 20 via voicing circuit 22, under control of tab switches 24, to amplifier 12.

The circuit of the accompaniment manual of the organ is modified somewhat to provide a special effect circuit. Special effect circuits associated with the accompaniment manual are well known in the art and range from playing of a full chord in the accompaniment voices to the playing of complex rhythm patterns in the accompaniment voices, both in response to depression of only one of a predetermined set of keys of the accompaniment manual.

The special effects circuit in this instance may be assumed, for example, to be an automatic chords circuit, in which a full chord sounds in the accompaniment voices in response to depression of a single key of a group of control keys, which can be referred to as chord playing keys. It will be remembered, of course, that any of a variety of special effects circuits could be used and the one referred to is merely exemplary.

The accompaniment manual 26 is connected through a keyer control circuit 28 to keyers 30. Keyer control circuit 28 has an input connected from a mode selector switch 32 which has a "normal" position for normal operation of the accompaniment keyboard. When switch 32 is placed in the "chord" position, keyer control circuit 28 will be inhibited from normal operation and, instead, at least a portion of the manual 26 supply an encoding circuit 34. The keys of the position of keyboard 26 referred to may be designated "chord playing" keys.

Circuit 34 encodes key depressed signals into a four bit binary word, which is supplied to four wire line 36. Line 36 is also connected to the input of a chord generator circuit 38 which converts the four bit binary word into enabling signals at selected ones of the outputs of circuit 38, which are connected as additional activating inputs to keyers 30, isolated, as necessary, by diodes and the like.

FIG. 1 shows an additional input to circuit 34 from pedal manual 16 to demonstrate that circuit 34 may encode the chord playing keys of manual 26 or the depressed one of the keys of the pedal manual 16. It is not uncommon for this option to be controlled automatically by the rhythm selector switch. As is shown in FIG. 1, the selection may be manually controlled as by selector switch 40.

Activating signals to keyers 30 will enable selected ones of keyers 30 to pass respective outputs of tone generator 6 and voicing circuit means 42 which shapes the tone signals and supplies the shaped signals to amplifier 12.

The tab control input to voicing circuit 42 is conventional and is connected to the output of the portion of the circuit of the present invention.

The remaining portion of the circuit of FIG. 1 is a greatly simplified block diagram of the circuit of the present invention. The remainder of the disclosure will be limited to that circuit.

Specifically, in FIG. 1, a chord memory circuit 44 is provided which automatically stores the four bit binary word developed on cable 36 upon the depression of a chord playing key. These words are stored in successive memory locations, or lines, and can be recalled in the same order in which they were stored.

The output of memory 44 is reconnected to line 36 so that, when the system is operated in the playback mode, the word stored in memory 44 will be developed on line 36 and form an input to chord generator 38.

In addition to the chord memory circuit 44, there is a tab memory circuit 46. Circuit 46 operates to store the patterns of tab switch 48 settings which are to be effective as the respective chords are played. The tab memory circuit 46 stores the patterns in which the tab switches 48 are set each time a chord key is depressed after the tab switch pattern has been altered.

Tab switch interface circuit 50 receives signals from either the tab switches 48 or the tab memory circuit 46 and controls voice circuit means 42.

Figure 2:
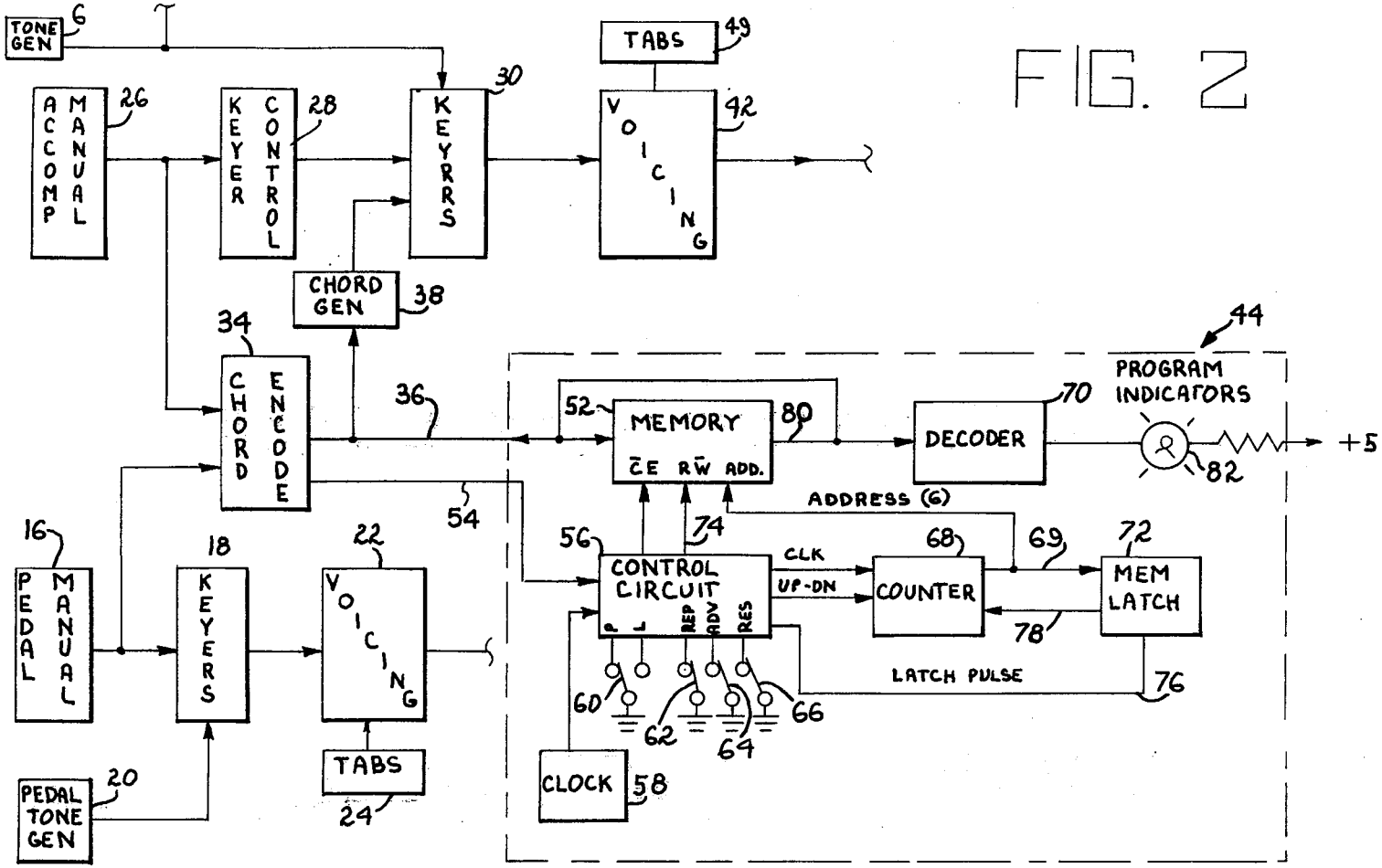
FIG. 2 is a somewhat more detailed block diagram of a portion of an organ circuit embodying a portion of the circuit of the present invention.

Referring to FIG. 2, the circuits relating to the chord memory circuit 44 are shown in more detailed form. For simplification, memory circuit 46 is not shown in FIG. 2. Rather, a set of tab switches 49 are shown connected in conventional manner to voicing circuit means 42.

The chord memory circuit 44 is shown inside of a dot-dash box labeled 44 in FIG. 2. The four bit chord word on line 36 is connected to the input of a memory 52. A second output from chord encode circuit 34 and which consists of a pulse each time the pattern of depressed keys of the accompaniment manual is changed, and which is on wire 54, is connected to the input of a control circuit 56. A key change signal from wire 54 initiates a write pulse to memory 52 causing the four bit word presently on line 36 to be stored in the next memory location.

Control circuit 56 receives a timing signal from a high frequency clock 58, and receives control information from a set of control switches 60, 62, 64 and 66 connected thereto and to be discussed hereinafter. Switch 60 controls the mode of operation for control circuit 56, and when in the FIG. 2 position, causes circuit 56 to "program", or store, each new word on cable 36 in a respective position in memory 52. With switch 60 in the other position, control circuit 56 will operate in a playback mode, and information stored in memory 52 will be developed at the output of memory 52.

Switch 62 is a reverse switch and will cause the control circuit 56 to over write the next word supplied from chord encode circuit 34 into the previous memory location rather than into the next memory location in memory 52. This switch is used to correct errors occurring during programming.

Switch 64 allows the operator to program a "no" chord, or pause, or rest, in the memory 52 by advancing the memory counter to the next location without depressing a chord playing key.

Switch 66 is a reset switch, and allows the operator fully to reset the counter which controls memory 52, thereby enabling the player to start his programming over.

Also shown within the circuit 44 in FIG. 2 are a counter 68, a decoder 70, and a memory latch 72. In operation, control circuit 56 develops a clocking pulse on the line labeled CLK in FIG. 2 each time the chord encode circuit 34 develops a "change key" pulse on line 54, or when either reverse switch 62 or advance switch 64 is depressed. A second line connected from control circuit 56 to counter 68 and labeled UP-DN, controls the direction in which counter 68 will count.

Whenever a new chord key is depressed, in manual 26, or when the advance switch 64 is pressed, counter 68 will increase its count by one. However, if reverse switch 62 is depressed, counter 68 will decrease the count by one. The count output of counter 68, on line 69, is connected as a first input to memory latch 72 and as the addressing input to the ADD terminal of memory 52. Counter 68 controls the location of memory 52 to be used for the next word on line 36.

Shortly after counter 68 is pulsed, control circuit 56 will produce a pulse on wire 74 which is connected to the read-write input of memory circuit 52. The pulse on wire 74 will cause the binary word on line 36 to be stored in the location of memory 52 which has been made available by the count from counter 68.

Control circuit 56 produces another pulse on line 76 which is connected as the clocking input to memory latch 72. Each time counter 68 is pulsed, the memory latch circuit 72 will also be pulsed from line 76 and the count from counter 68 stored therein.

Memory latch circuit 72 is used to record the location of the last used location of memory circuit 52. This information is used primarily in the playback mode during which circuit 72 will produce a pulse on line 78 whenever the output of counter 68 is equal to the stored contents of memory latch 72. In this manner, when in the playback mode, counter 68 is automatically reset each time the full set of stored words in memory 52 have been scanned, and thus allowing the player to restart the sequence without manually resetting counter 68.

Memory circuit 52 produces an output at terminal means 80 during those times when the control circuit 56 is switched to the playback mode. Output terminal means 80 is connected to the input of a decoder circuit 70. Decoder circuit 70 receives the four wire output from memory circuit 52 and enables one of sixteen outputs of decoder 70, which are indicated diagrammatically in FIG. 2 as a single line output consisting of a programmed indicator light 82.

It will be noted that the input of memory circuit 52 is connected to line 36. With control circuit 56 switched to "program" mode, binary words developed on line 36 from chord encode 34 will be connected to the input of memory circuit 52, and will also be connected to the inputs of decoder circuit 70, so that when a chord playing key is depressed, the binary word corresponding to the respective chord will be stored in the appropriate memory location in memory 52, and an appropriate respective indicator light 82 will also light. Also, with control circuit 56 in the playback mode, words developed at the output 80 of the memory circuit 52 will also control the program indicator lights through decoder circuit 70 and will simultaneously develop the corresponding four bit word on line 36, to form inputs to chord generator circuit 38.

Figure 3A:
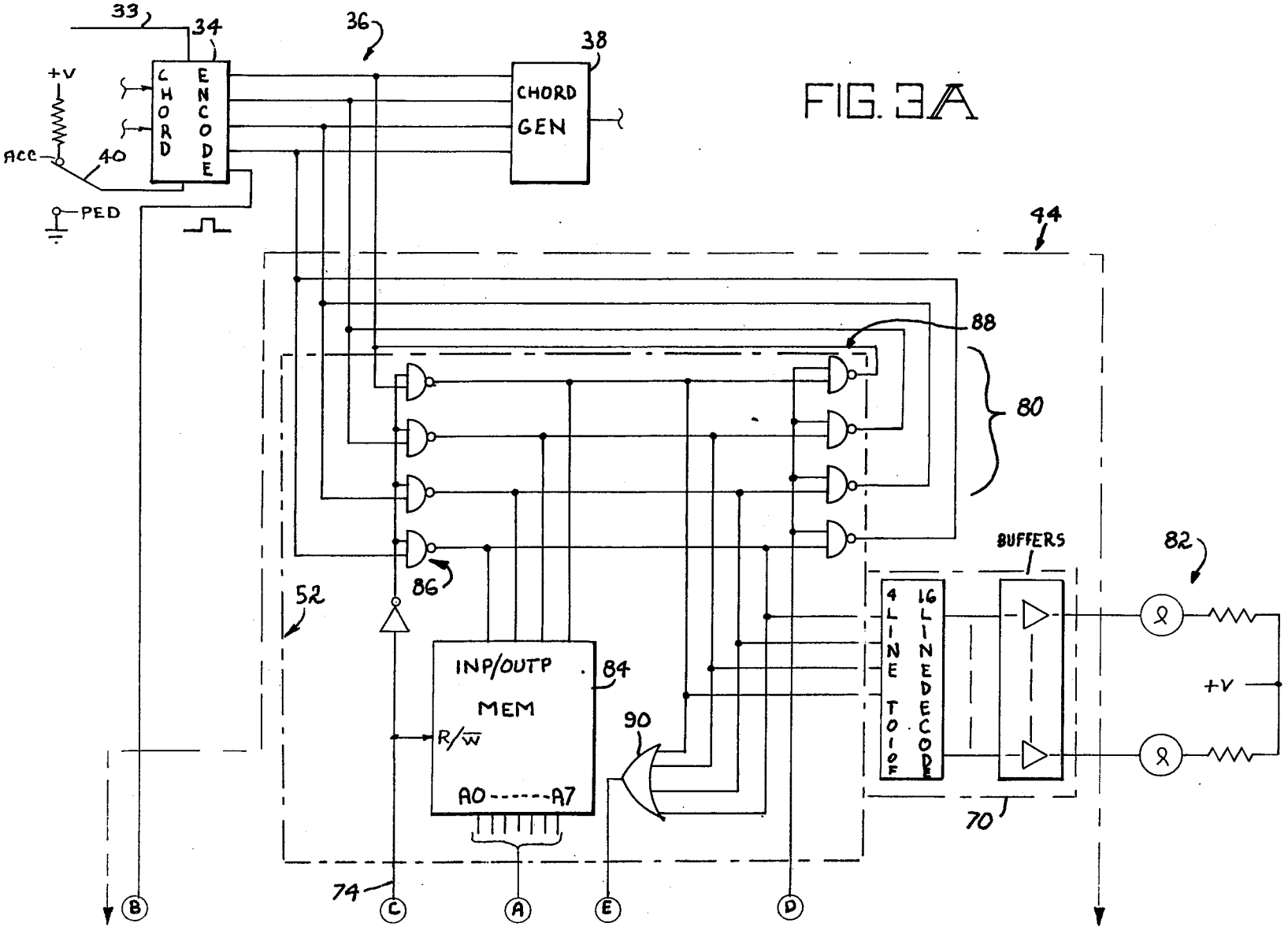
FIGS. 3A and 3B show a schematic diagram of a portion of the circuit of the present invention.
Figure 3B:
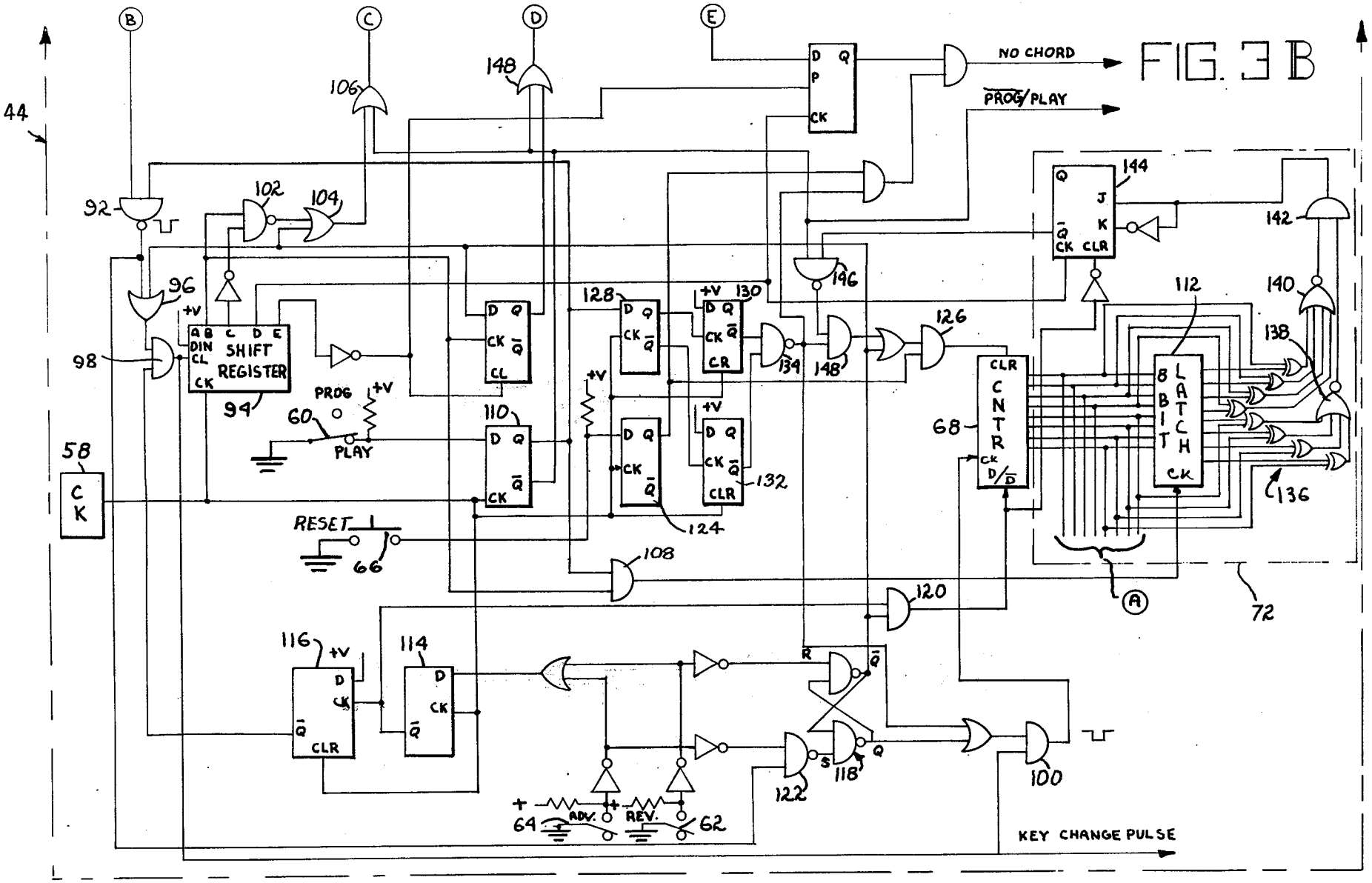

FIGS. 3A and 3B, taken together, are a detailed schematic of the circuits shown within the block labeled 44 in FIG. 2.

The circuits of FIG. 3A will readily be seen to consist of memory circuit 52, decoder circuit 70 and the program indicator lights 82.

It will be seen in FIG. 3A that memory circuit 52 consists of a memory device, such as a semi-conductor memory chip 84, and input gates 86 and output gates 88. Gates 86 and 88 are interconnected, as shown in FIG. 3A, to the input-output terminal means of memory chip 84. The pulse on line 74, as previously discussed, will momentarily allow the four bit word at the output of encoder circuit 34 to pass through input gates 86 and be developed at the input terminal means, or port, of memory chip 84. Simultaneously, the read-write control input of memory chip 84 will be switched to the "write" mode and the information developed on the input port memory chip 84 will be stored in the location addressed by the addressing input indicated at A0 to A7 in FIG. 3A.

The four line input-output terminal means of memory 84 is also connected to the inputs of a four input OR gate 90, which forms a no chord detect circuit, and develops a logic zero level at the output labeled E in FIG. 3A, whenever the four line input-output terminal means of memory 84 is at lobic 0000.

A further input terminal labeled (D) in FIG. 3A is switched to logic level one whenever the control circuit 56 is switched to the playback mode. Input terminal (D) is connected to one input of each of the output gates 88 and will allow the words developed at the output of memory chip 84 to pass through to the output terminal means 80 and, therefore, to line 36.

FIG. 3B includes control circuit 56, counter 68 and memory latch circuit 72. Four terminals are shown at the top of FIG. 3B, and consists of terminals labeled B, C, D and E, respectively. These terminals correspond to similarly labeled terminals at the lower portion of FIG. 3A. A fifth such terminal in FIG. 3B is located in the righthand portion and consists of the output terminal from counter 68, and is labeled A. Terminal B in FIG. 3B receives the "change key" pulse from chord encoder circuit 34, and is connected as a first input to the NAND gate 92. NAND gate 92 inverts the "change key" pulse from terminal B and produces a negative going pulse which is routed through an OR gate 96 and an AND gate 98 to the clear terminal of a shift register 94.

During the negative going portion of the output of AND gate 98, shift register 94 will develop logic zero signals at each of the five output terminals thereof, labeled A through E in FIG. 3B.

The output of AND gate 98 is also connected through an AND gate 100 to the clocking terminal of counter 68. When the negative going pulse from NAND gate 92 returns to logic one, shift register 94 will be enabled, and counter 68 will be clocked to count up for one count. Once shift register 94 is enabled by the logic one level at the output of AND gate 98, clock signals from clock circuit 58 connected to the clocking terminals of shift register 94 will cause a logic one signal to shift into the first output terminal A thereof, and to shift one bit for each rising edge developed by clock 58.

In this manner, a logic one signal will be developed at the B output of shift register 94 to clock pulses after the key down pulse from chord encode circuit 34. When the logic one signal is developed at the B output of shift register 94, and while the C output thereof is still at logic zero, both of the inputs to a NAND gate 102 will be at logic one and, therefore, the output of NAND gate 102 will pulse to logic zero.

The output of NAND gate 102 is routed through an OR gate 104 and a second OR gate 106 to the terminal labeled C in FIG. 3B. Terminal C from FIG. 3B corresponds to wire 74, which has previously been discussed as the read-write control input to memory chip 84.

The negative going pulse from NAND gate 102 will cause the memory chip 84 to store the four bit binary word from input gates 86 into the memory location addressed by the addressing inputs A0 to A7 at chip 84. At the next clock edge from clock circuit 58, the A logic one signal will be developed at the C output of shift register 94, and the output of NAND gate 102 will, therefore, revert to a logic one signal, thus returning memory chip 84 to the read mode.

Output terminal B from shift register 94 is also connected to a first input of an AND gate 108. The second input to AND gate 108 is connected to the Q output of a flip flop 110. The D input to flip flop 110 is connected to the program play selector switch 60. When selector switch 60 is placed in the program position, a logic one signal will be presented to the input of flip flop 110, and will be developed at the Q output thereof. With selector switch 60 placed in the program position, the second input to AND gate 108 will also, therefore, be at a logic one, and the logic one signal from the B output of shift register 94 will pass through AND gate 108 to the clocking input of an eight bit latch 112, forming the latch portion of memory latch circuit 72.

In this manner, the output of counter 68 is latched into eight bit latch 112 each time a new one of the chord playing keys of manual 26 is depressed.

The D and E outputs of shift register 94 are utilized primarily in the playback mode and will be discussed hereinafter.

It is also possible to program a binary word corresponding to no chord keys depressed into memory chip 84 in order to program, for instance, a pause.

This is accomplished by depressing of advance button 64 when program play selector switch 60 is in the program position. Advance switch 64 operates through an inverter and through an OR gate as shown in FIG. 3B to present a logic one signal to the B input of a flip flop 114. Flip flop 114 and flip flop 116 are connected to form a monostable multivibrator, which serves to eliminate key bounce from the advance push button 64 and the reverse push button 62. When the advance push button is pressed, the pulse developed at the output of flip flop 116 is connected to the second input of NAND gate 98, and will initiate the same sequence of events as occurred in relation to the key down pulses developed by the chord encode circuit 34.

The difference between the pulses from chord encode circuit 34 and those developed in response to the advance button 64 is that the four bit word developed at the output of the input gates 86 will now be a four bit logic one word, or count fifteen, which corresponds no chord keys depressed.

Circuitry, including switch 62, is also provided to allow the player to back up one step in order to edit, or correct, a previous key depression. When reverse switch 62 is depressed, flip flops 114 and 116 will produce a pulse identical to that obtained by depression of advance switch 64. However, depression of reverse switch 62 will operate to reset an RS flip flop 118. The $\overline{Q}$ output of flip flop 118 is connected through an AND gate 120 to the UP/DOWN control terminal of counter 68, so that when the clocking pulse from AND gate 92 returns to logic one to clock counter 68, counter 68 will count down one count instead of up one count.

The $\overline{Q}$ output of flip flop 118 is also connected to the second input of OR gate 104. When flip flop 118 is reset, as by the reverse push button 62, OR gate 104 will operate to block the pulse developed by NAND gate 102, and will thereby prevent the pulse developed by 102 from clocking the memory chip 84 in FIG. 3A.

When a new key is depressed in accompaniment manual 26, and a key change pulse is developed by chord encode circuit 34, the pulse from NAND gate 92, which clears shift register 94, will also reset flip flop 118 through AND gate 122. Once flip flop 118 is reset, the $\overline{Q}$ output thereof will return to a logic zero signal and will then allow pulses from NAND gate 102 to reach memory chip circuit 84. Flip flop 118 could also be reset by depression of the advance switch 64, as can be seen in FIG. 3B.

A reset switch 66 is also provided which allows the player to fully reset counter 68 to zero, should he desire to start the programming over. Reset switch 66 is connected to the D input of a flip flop 124. Flip flop 124 is clocked by pulses from clock circuit 58, and will, therefore, transfer the logic zero signal developed when the reset push button is depressed from the D input thereof to the Q output thereof. The Q output of flip flop 124 is connected through an AND gate 126 to the clear terminal of counter 68. Thus, the logic zero signal developed at the output of flip flop 124 whenever reset button 66 is pushed will clear counter 68 to count zero.

Three additional flip flops, namely, 128, 130 and 132 are also provided, and operate to reset counter 68 either when the program play switch 60 is switched from "program" to "play", or when it is switched from "play" to "program". More specifically, the Q output of flip flop 110, which is controlled by selector switch 60, is connected to the (D) input to flip flop 128. The Q output of flip flop 128 is connected to the clock terminal of flip flop 130, and the $\overline{Q}$ output of flip flop 128 is connected to the clocking terminal of flip flop 132.

Flip flops 130 and 132 are D type edge triggered flip flops. These flip flops will transfer the logic level connected to the D input thereof to the Q output, and the inversion of that level to the $\overline{Q}$ output, each time a rising edge occurs at the clocking input thereof. When the selector switch 60 is changed from "play" position to "program" position, the Q output of flip flop 110 will switch to a logic one signal, and the Q output of flip flop 128 will also switch to logic one. The change from logic zero to logic one at the Q output of flip flop 128 will present a rising edge to the clocking terminal of flip flop 130. Correspondingly, the $\overline{Q}$ output of 130 will change from logic one to logic zero.

The clear terminal of flip flop 130, and also the clear terminal of flip flop 132, is connected to the clock outputs of clock circuit 58 and will reset flip flop 130 shortly after the rising edge developed from the Q output of flip flop 128.

The $\overline{Q}$ output of flip flop 130 will, therefore, develop a short negative going pulse immediately after selector switch 60 is switched from the play position to the program position. This negative pulse is routed through a NAND gate 134 and an AND gate or OR gate through AND gate 126 to the clear terminal of counter 68, and will, therefore, reset counter 68 each time the program play selector swtich 60 is switched from the "play" position to the "program" position.

Similarly, flip flops 128 and 132 will operate to produce a negative going pulse which is connected to the second input of NAND gate 134 each time the selector switch 60 is switched from the "program" position to the "play" position.

Referring now to the memory latch circuit 72, as shown in FIG. 3B, it will be seen that the inputs to eight bit latch 112 and the outputs thereof are each connected to two input exclusive OR gates 136. Gates 136 operate through NOR gates 138 and 140 and AND gate 142 to control the J and K inputs to a JK flip flop 144.

Flip flop 144 is clocked each time the logic one signal in shift register 94 is shifted to the D output thereof. So long as the inputs to latch 112 and the outputs thereof are unequal, flip flop 144 will present a logic zero signal at its Q bar output. However, when the input to eight bit latch 112 and the output therefrom are equal, flip flops 144 will produce a logic one signal at the Q bar output thereof, which will allow NAND gate 146 to switch to a logic zero signal which will operate to reset the counter 68 through AND gate 148 and AND gate 126.

The second input to NAND gate 146 is connected to the Q bar output from flip flop 110. The Q bar output of flip flop 110 will be at a logic zero level whenever the program selector switch 60 is in "program" position, and will hold the output of NAND gate 146 to logic one to block the resetting pulses from flip flop 144 which occur while programming the series of chord keys into the memory.

Flip flop 144 then allows the player to cycle through the chords stored in memory chip 84, and will reset the counter 68 to zero once the last chord which was previously stored in memory chip 84 has been recalled, thus starting the cycle over. The Q bar output from flip flop 110 is also connected to the second input of OR gate 106, and will prevent any pulses produced by NAND gate 102 from effecting a write cycle in memory chip 84. Rather, the Q bar output of flip flop 110 is also connected to an input of OR gate 148 and, when selector switch 60 is in the "play" position, OR gate 148 will enable the output gate 88 in FIG. 3A.

The Q output of flip flop 110 is also connected to the second input of NAND gate 92, and prevents any key change pulses from encoder circuit 34 from effecting shift register 94 when selector switch 60 is in "play" position.

When selector switch 60 is in "play" position, the player can step through the chords stored in memory chip 84 one by one by successive depressions of advance switch 64. Each time switch 64 is pressed, flip flops 114 and 116 will operate as previously discussed and will clock counter 68. However, the write command pulse developed from NAND gate 102 will be blocked at OR gate 106 as mentioned above.

The outputs shown at the right hand side of FIG. 3B and, more specifically, the outputs labeled program/-play, key change pulse, and the output of counter 68 indicated by the letter A, and the output at the top of FIG. 3B, labeled C, will be used later with reference to FIG. 6, and it will be discussed in more detail at that time.

Figure 4:
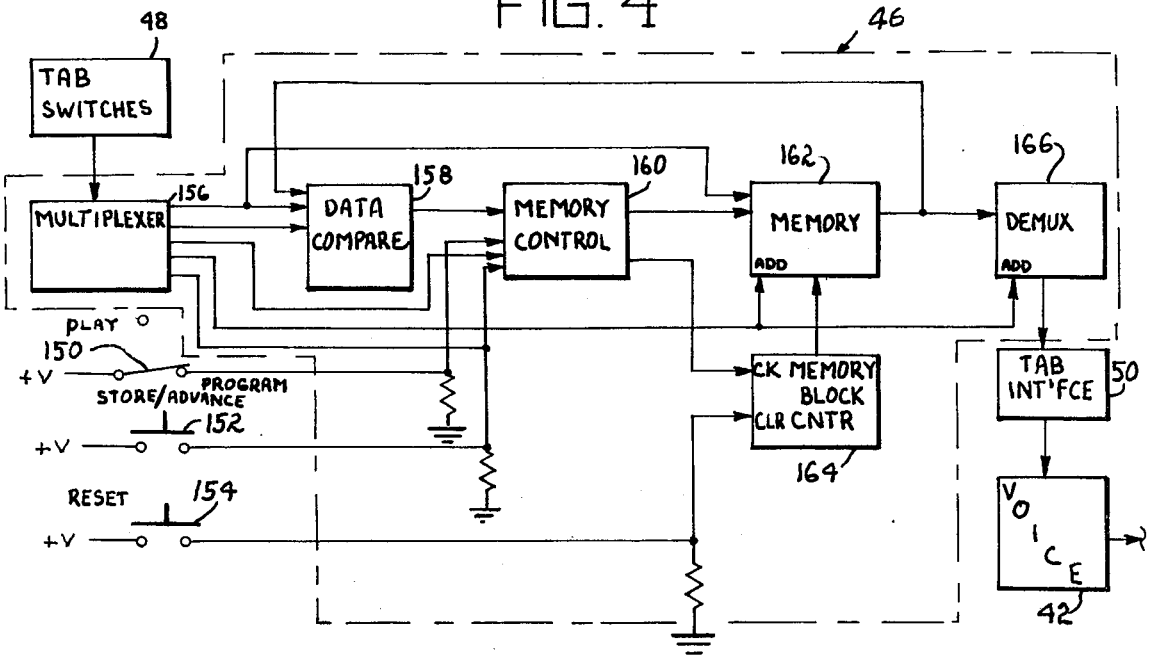
FIG. 4 is a block diagram of a portion of an organ circuit embodying a portion of the present invention.

Referring now to FIG. 4, tab switches 48 and the tab switch memory circuit 46 are shown in simplified block form. Also shown as inputs to tab memory system 46 are a "play-program" selector switch 150, a "store-advance" switch 152 and a "reset" switch 154. Tab memory system 46 consists of a multiplexer 156, a data compare circuit 158, a memory control circuit 160, a memory 162, a memory lock counter 164, and a demultiplex circuit 166.

Multiplexer 156 scans tab switches 48 and produces an electronic data stream which is connected as an input to the data compare circuit 158, and to memory 162. The data stream connected from multiplexer 156 to data comparer 158 is continuously compared with a data stream produced by memory 162. Memory circuit 162 produces a data stream which is synchronized with the outputs of multiplexer 156. Any time a tab switch is changed or, rather, when the pattern of tab switches 48 is changed, data compare circuit 158 will develop an output on wire 168, which is connected to memory control circuit 160.

Memory control circuit 160 will then allow a pulse received by depression of the "store/advance" switch 152 to clock the memory block counter 164 and to switch memory 162 into the write mode for one complete scan of multiplexer 156. The input from switch 152 is also connected to the multiplexer 156 and resets the counter used in multiplexer 156 to insure that a complete cycle of tab switches 48 is stored in memory 162.

When selector switch 150 is switched to the "play" position, and switch 152 is pressed, memory control circuit 160 will clock memory block counter 164, but will not switch memory 162 into the "write" mode. Memory block counter 164 controls the line of memory 162 which will either be written into or read from as the addressing input from multiplexer 156 counts.

Demultiplexer 166 receives the data stream from memory 162 and develops outputs connected to the tab interface circuit 50 for controlling voice circuits 52.

A reset switch 154 is also provided, as shown in FIG. 4, for fully resetting memory block counter 164 should the player desire to reprogram memory 162.

Figure 5:
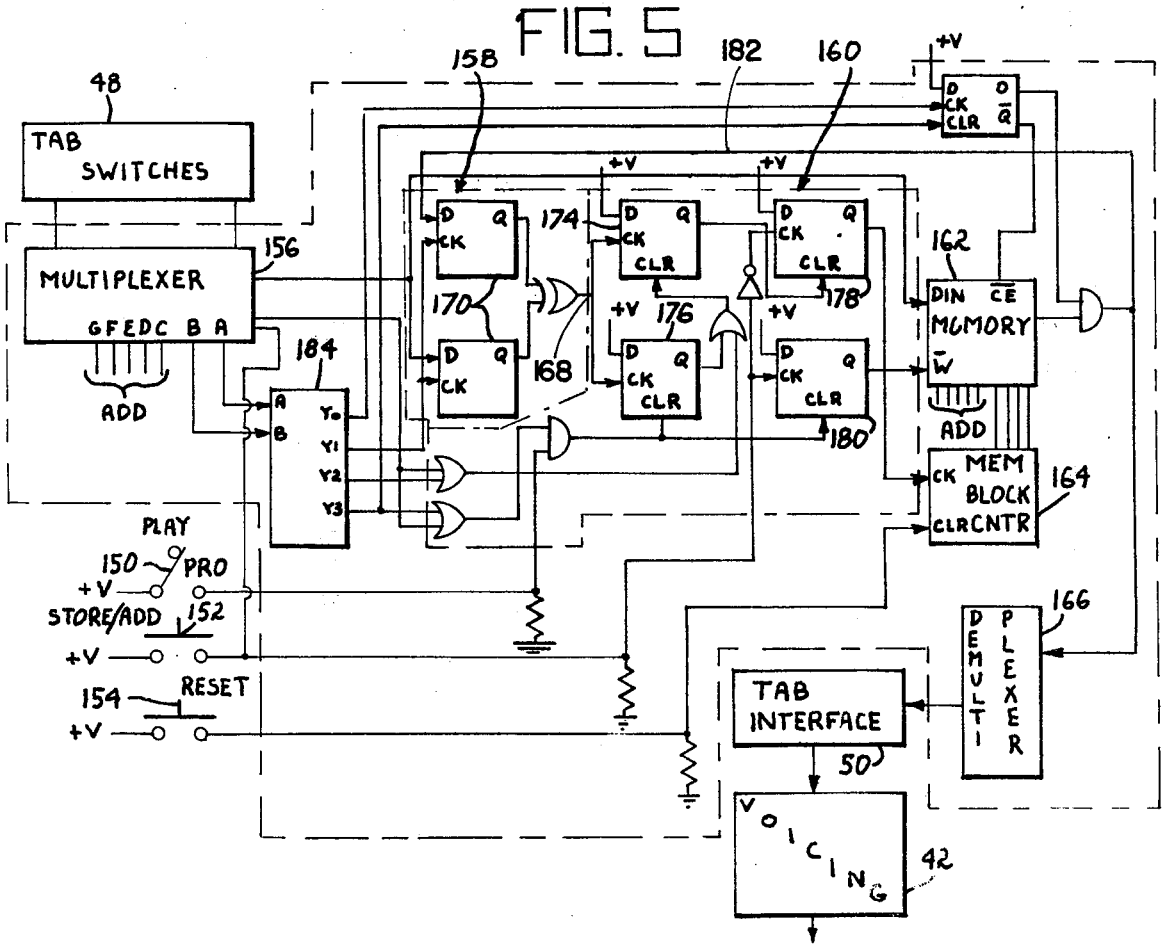
FIG. 5 is a schematic diagram of a further portion of the present invention.

Circuit 46 may be somewhat more fully understood by reference to FIG. 5.

Data compare circuit 158 consists of a pair of D type flip flops 170 and an exclusive OR gate 172. Whenever the data stream developed at the output of memory chip 162 is different from the data stream developed by multiplexer 156, the output of exclusive OR gate 172 will switch to a logic one level and will clock D type flip flops 174 and 176, inside memory control circuit 160.

The Q output of flip flop 174 resets a flip flop 178, which prepares flip flop 178 to clock memory block counter 164 when switch 152 is pressed. When switch 152 is pressed, flip flop 178 will reset, establishing a logic one at the Q output thereof and clocking memory block counter 164. This addresses the next line in memory circuit 162.

When "store" switch 152 is again released, flip flop 180 will be triggered, and memory circuit 162 will be switched to the "write" mode and the counter in multiplexer 156 will be released to count. As the counter in multiplexer 156 counts through a cycle, multiplexer 156 will produce a data stream on wire 182, which is also connected to the data input of memory chip 162. As the counter counts through a cycle, the data stream developed by multiplexer 156 will be stored in the successive locations in memory chip 162.

When selector switch 150 is in "play" position, the input to circuit 46 therefrom will prevent flip flop 180 from being set by the input from switch 152. Therefore, when switch 152 is pressed, memory block counter 164 will be advanced one count, but memory chip 162 will not be switched into "write" mode, and data can than be read therefrom into the multiplexer circuit 166.

In order to provide proper timing pulses for the circuit in FIG. 5, a four phase clock is generated in chip 184 and produces successive pulses on outputs labeled Y0 to Y3, with a full set of pulses on these outputs occurring for each count of the counter in multiplexer 156.

Multiplexer 156 produces an additional output pulse when the multiplex counter reaches count 32. This count is used through an OR gate and an AND gate to reset flip flop 180 after one full cycle of tab switch information has been written into memory 162. This prevents erroneous and extra programming of memory circuit 162 once the store button 152 has been pressed.

Figure 6:
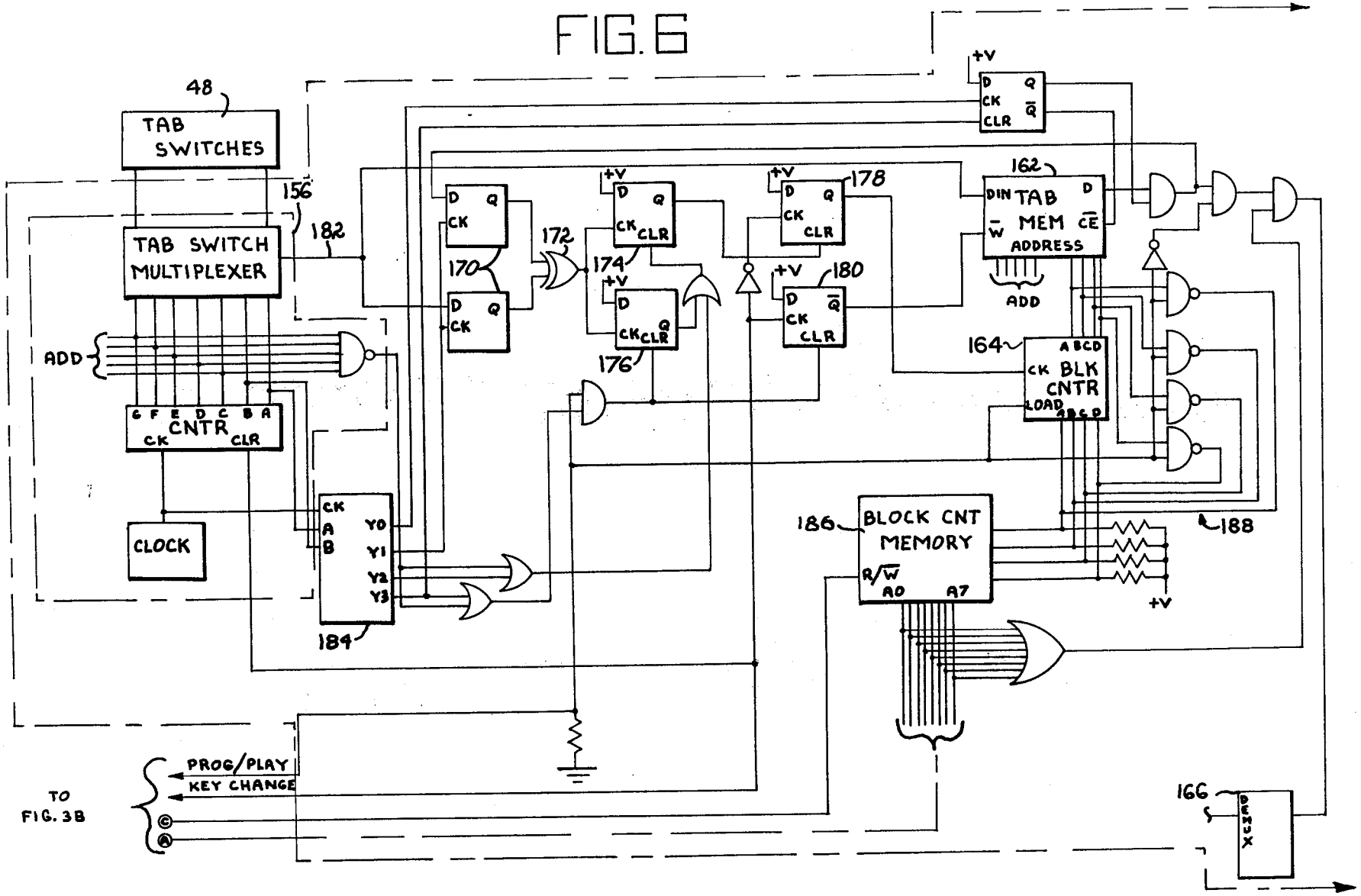
FIG. 6 is a schematic diagram of the circuit of FIG. 5, showing the modifications required to combine the circuits of FIG. 5 and FIG. 3.

FIG. 6 shows the circuit of FIG. 5 including some modifications necessary to operate the tab switch memory from the outputs provided by the chord memory control circuit 56 as previously discussed in reference to FIG. 3B.

Additionally, for clarification, multiplexer 156 is shown in slightly greater detail in FIG. 6 to indicate the counter and the count thirty-two decoder circuit used therein.

The operation of the circuit of FIG. 6 is identical with that of the circuit of FIG. 5, with the exception of a block count memory 186, and the fact that the program, play, store command and reset command are now received from the outputs of control circuit 56 rather than from respective switches as shown in FIG. 5.

It will be seen that the circuit shown in FIG. 6 will be switched into "program" mode when the chord memory circuit is switched into "program" mode and that, instead of store, or advance, signals from a push button 152, the key change pulses developed in control circuit 56 are connected to perform this service.

Block count memory 186 receives the four bit output of block counter 164 through NAND gate 188 whenever the "program-play" selector switch 60 is switched to "program" position.

Additionally, the eight bit address word from counter 68, in FIG. 3B, is connected as the addressing input to memory 186, and the memory write pulse developed in NAND gate 102 in FIG. 3B, and connected to the terminal labeled C in FIG. 3B, is connected to the read-write control input to memory 186.

In operation, with the system in "program" mode, the four bit output of block counter 164 is stored in a location, or line, in block counter memory 186 each time a chord playing key is depressed. Since block counter 164 advances one count each time the tab switch information is changed, the four bit words stored in the respective locations of block count memory 186 indicate the set of tab switch patterns corresponding to each chord stored in the respective locations in memory chip 84.

When "program-play" selector switch 60 is switched to the "play" position, the block memory 186 will be switched to the "read" mode and will develop at its output terminals the four bit words corresponding to the locations in memory chip 84 as counter 68 is clocked. The output of block memory 186 is connected to the data input terminals of block counter 164, and the load control terminal of counter 164 is connected to the "program-play" input terminal from control circuit 56.

When the circuit is in "play" mode, the signal developed at the load terminal of counter 164 will cause the four bit input from block memory 186 to be transferred to the four bit output of block counter 164. Therefore, as the output of counter 68 is clocked, the corresponding section of the tab memory chip 162 will be addressed.

Information of any sort that can be selected can be stored by the arrangement according to the present invention including information pertaining to rhythms, presets, tremelo, vibrato, volume, or expression control as well as other selectable or variable elements under the control of the organ player.

Modifications may be made within the scope of the appended claims.

What is claimed is:

1. In an electronic organ having tone generator means connected to transducer means via keyers, playing keys, and playing key controlled means for developing a respective data signal for each playing key which is actuated, a note sequencer comprising:

a memory having a plurality of storage locations, mode switch means for placing said note sequencer alternatively in a playback mode and a program mode, record means operable when said note sequencer is in the program mode for sequentially writing a plurality of said data signals into said memory for storage therein, playback means operable when said sequencer is in the playback mode for reading the stored signals from said memory, control means including a player actuated advance switch for causing said playback means to advance from one signal to the next for reading the respective data signals stored therein in the same order in which the signals were written each time said advance switch is actuated with only one of said signals being read each time said advance switch is actuated, and means for actuating said keyers in conformity with the data signals read from said memory.

2. The organ of claim 1 wherein said record means enters said data signals into respective said storage locations in a predetermined sequence and said playback means addresses said storage locations in said predetermined sequence to read the stored data signals therefrom.

3. The organ of claim 2 wherein said control means disables said playback means from moving from any one storage location to the next in the sequence except when said advance switch is reactuated.

4. The organ of claim 1 in which said playing keys include a group of chord keys each of which is operable, when depressed, to cause a plurality of said keyers to be actuated to sound a chord, encoder means connected to said group of keys for producing a respective encoded said data signal for each of the group of chord keys which is depressed, decoding means interposed between said encoder means and said keyers to route keyer actuating signals to respective ones of the keyers for each said encoded data signal, said memory being adapted to store the encoded data signals when said mode switch means is in the program mode, and said playback means supplies a different one of said stored encoded data signals to said decoder means each time said advance switch is actuated when said mode switch means is in the playback mode.

5. The organ of claim 1 including:

a plurality of voicing circuits, at least one tab means for each said voicing circuit moveable into position to supply an enabling signal to its respective voicing circuit, said record means being operable to sequentially write a plurality of tab data signals corresponding to respective said enabling signals into a tab memory, said playback means advancing from one tab data signal to the next in the same order in which they were written each time said advance switch is actuated with only one of said tab data signals being read each time said advance switch is actuated.

6. In an electronic organ according to claim 5 which includes means for scanning said tab means to develop a data stream consisting of time-displaced signals with a signal corresponding to each tab means in a respective time slot, said record means includes means for storing said time-displaced signals in a respective location of said memory when said advance switch is actuated, and means for then disabling said memory from the storage of new time-displaced signals from said tab means until the position of at least one tab means is changed.

7. An electronic organ according to claim 5 in which the tab data signals are written into said memory in response to actuation of said advance switch during program mode and are read therefrom in response to the actuation of said advance switch during playback mode, and including control means connected to said memory and to said advance switch operable to control the reading from said memory to maintain the same relation between the tab data signals and the data signals from the playing keys that obtained during writing thereof into the memory.

8. An electronic organ according to claim 2 which includes manual means operable at least when said mode switch means is in program mode for changing the order in which the locations of said memory means are addressed by said playback means.

9. An electronic organ according to claim 4 in which said manual means includes: switch means for stepping back the addressing of the memory by said playback means from one said location to the next location, and switch means for causing said playback means to return to the first written in location of the memory.

10. In an electronic organ having tone generator means connected to transducer means via keyers, playing keys, and playing key controlled means for developing a respective data signal for each playing key which is actuated, a note sequencer comprising:

a memory having a plurality of storage locations, mode switch means for placing said note sequencer alternatively in a playback mode and a program mode, record means operable when said note sequencer is in the program mode for sequentially writing data signals in respective locations in said memory in the same order in which said signals are developed by the actuation of the playing keys, playback means operable when said note sequencer is in the playback mode for sequentially addressing the locations in which said signals are stored to thereby read the signals in the same order in which they were stored, control means including a player actuated advance switch for causing said playback means to advance from one storage location to the next for addressing the respective storage locations each time said advance switch is actuated and to advance only once each time said advance switch is actuated whereby the timing of reading the stored signals is under player control, and means for actuating said keyers in conformity with the data signals read from said memory.

11. In an electronic organ having a plurality of voicing circuits and at least one tab switch means for each said circuit moveable into position to supply an enabling signal to its respective voicing circuit, a tab preset sequencer comprising:

a memory having a plurality of storage locations, mode switch means for placing said tab preset sequencer alternatively in a playback mode and a program mode, record means operable when said tab preset sequencer is in the program mode for sequentially writing tab data signals representative of the respective tab preset combination settings in respective locations of said memory in the same order in which said tab data signals are developed by the settings of the various tab combinations, playback means operable when the tab preset sequencer is in the playback mode for sequentially addressing the locations in which said tab data signals are stored to thereby read the tab data signals in the same order in which they were stored, control means including a player actuated advance switch for causing said playback means to advance from one storage location to the next for addressing the respective storage locations each time said advance switch is actuated and to advance only once each time said advance switch is actuated whereby the timing of reading the stored tab data signals is under player control, and means responsive to the tab data signals read from said memory to provide to said voicing circuits enabling signals corresponding to the tab switches represented by the tab data signals read from said memory.

12. The organ of claim 11 wherein said tab data signals are binary words representing the respective tab preset combinations.

13. In an electronic organ having a keyboard with a melody section having melody playing keys and an accompaniment section having accompaniment playing keys and in which depression of a melody playing key develops a signal which causes a respective pitch to sound while depression of an accompaniment playing key develops a signal which causes a respective chord to sound, and a method of operating the organ comprising: sequentially depressing accompaniment playing keys in the order in which the pertaining chords appear in a selected composition and storing the signals in the order of development thereof, thereafter playing the melody portion of the composition by depression of the melody playing keys, and recalling said stored signals in sequence and in tuned relation to the playing of said melody portion of the composition by repeatedly actuating a single non-playing key switch thereby incrementally stepping through the stored sequence of signals and recalling only a single stored signal each time the switch is actuated.

14. The method according to claim 13 in which the organ includes stop tabs and said method includes storing signal means corresponding to the settings of the stop tabs and recalling the stored signal means together with the recalling of the stored signals pertaining to said accompaniment playing keys.

* * * * *